US006093090A

United States Patent [19]

Tosto et al.

[11] Patent Number: 6,093,090

[45] Date of Patent: Jul. 25, 2000

[54] REVERSIBLE CLAMPING HUB

[75] Inventors: Anthony C. Tosto, O'Fallon; Dennis A. Dohogne, St. Peters, both of Mo.

[73] Assignee: The Stanley Works, New Britain, Conn.

[21] Appl. No.: 09/014,788

[22] Filed: Jan. 28, 1998

[51] Int. Cl.[7] ..... B24B 23/00; B24B 41/00

[52] U.S. Cl. ..... 451/342; 451/352; 451/359

[58] Field of Search ..... 83/651; 451/342, 451/343, 344, 352, 359; 408/239 R

[56] References Cited

U.S. PATENT DOCUMENTS

| | | | |
|---|---|---|---|
| 3,691,900 | 9/1972 | Novak et al. | 451/342 X |
| 3,731,565 | 5/1973 | Barkhurst | 82/34 R |
| 3,857,592 | 12/1974 | Koike | 289/17 |
| 3,989,113 | 11/1976 | Spring, Sr. et al. | 173/163 |
| 4,274,311 | 6/1981 | Ebert | 81/63 |
| 4,434,586 | 3/1984 | Muller et al. | 451/342 X |
| 4,512,693 | 4/1985 | Swanson | 408/239 R |
| 4,521,985 | 6/1985 | Smith et al. | 42/7 |
| 4,523,115 | 6/1985 | Cuneo | 310/50 |
| 4,573,370 | 3/1986 | Clemens | 74/337.5 |
| 4,602,534 | 7/1986 | Moetteli | 81/177.85 |
| 4,655,006 | 4/1987 | Block | 451/342 |
| 4,722,253 | 2/1988 | Chow | 81/63 |
| 4,729,193 | 3/1988 | Gant et al. | 451/342 |
| 4,779,382 | 10/1988 | Rudolf et al. | 451/342 |
| 4,934,220 | 6/1990 | Slusar et al. | 81/63.2 |
| 5,086,673 | 2/1992 | Korty | 81/59.1 |
| 5,199,330 | 4/1993 | Arnold et al. | 81/63.2 |
| 5,247,849 | 9/1993 | Sato | 74/475 |
| 5,406,752 | 4/1995 | Neff | 451/344 |
| 5,406,866 | 4/1995 | Badiali | 81/57.3 |
| 5,450,773 | 9/1995 | Darrah et al. | 81/57.39 |
| 5,461,950 | 10/1995 | Iwinski | 81/61 |
| 5,470,180 | 11/1995 | Jore | 408/239 |
| 5,490,683 | 2/1996 | Mickel et al. | 279/75 |
| 5,505,270 | 4/1996 | Wentworth | 173/1 |
| 5,509,331 | 4/1996 | Nickipuck | 81/58.3 |
| 5,522,288 | 6/1996 | Slusar et al. | 81/63 |
| 5,522,606 | 6/1996 | Pressley et al. | 279/91 |
| 5,538,464 | 7/1996 | MacKay, Jr. | 451/342 |
| 5,558,569 | 9/1996 | Lee | 451/342 X |
| 5,718,621 | 2/1998 | Turley | 451/342 |

*Primary Examiner*—Timothy V. Eley
*Attorney, Agent, or Firm*—Standley & Gilcrest LLP

[57] ABSTRACT

A clamping hub for coupling a tool wheel to a high speed rotary power tool which can be made to operate in both the clockwise and the counter-clockwise directions which will not become accidentally disengaged during operation in either direction is described.

15 Claims, 2 Drawing Sheets

REVERSIBLE CLAMPING HUB

BACKGROUND AND SUMMARY OF THE INVENTION

The present invention relates generally to rotary hand tools, and, more specifically, to a high speed pneumatic cut-off tool which is reversible, so as to be capable of selective rotation of the cutting wheel in either the clockwise or counter-clockwise direction.

Conventional rotary power cut-off tools have been provided only with the capability of rotating the cutting wheel in one direction. While rotary cut-off tools have many various applications, including numerous uses in and around the home, the present invention is particularly directed toward industrial uses with confined spaces and delicate, damageable surroundings or where especially high speeds of rotation and long periods of use may be required.

One of the drawbacks of rotary cut-off tools is that they tend to throw debris from the cut off the wheel as the material is cut. The debris is kicked off the wheel at a high velocity, and thus with a significant amount of force. Accordingly, anything which is impacted by the flying debris (which may include paint chips, sparks and metal slivers) may be scratched, gouged or otherwise marred. Likewise, a person positioned within the path of the flying debris may be injured, either by being struck by sparks or pieces of paint or metal moving at a high velocity, or by inhaling from the stream or cloud of dust produced by the cutting action.

Thus it is desirable to be able to control the direction in which the grinding wheel rotates, and thereby control the direction in which the resulting debris is thrown from the wheel, relative to the position of the object being cut and to the position of the user. Frequently in attempting to so control the flow of dust and debris, or similarly to control the direction of the wheel rotation for a specific effect on the workpiece, the power cut-off tool user is forced to assume a position which is at the least uncomfortable and perhaps even dangerous. Working for extended periods of time with the body twisted into an awkward position can result in long term physical problems, as well as increased fatigue and possible mistakes and accidents in the short run.

Although reversible motors are known for use in other hand-held power tools, such as commercially available drills and screwdrivers, they have not heretofore been successfully incorporated into high-speed rotary power cut-off tools. Rather, any attempt at using such a known motor in a reversible rotary power cut-off tool would have been unsatisfactory because in the reverse mode of operation the hub of the tool would become loose, and could literally fly across the room, with obvious dangerous consequences.

Thus it is an object of the present invention to provide a clamping hub for a reversible tool which can operate in a safe manner in both the clockwise and counter-clockwise directions, without risk of portions of the tool becoming loose and possibly airborne during use.

The present invention as described herein is described as it would be utilized in a reversible pneumatic cut-off tool. The use of the present invention is, however, not limited to pneumatically powered tools, nor is it limited to cut-off tools. Such a reversible clamping hub can be utilized in many applications including any rotary power tool which may operate in both the clockwise and counter-clockwise directions for which the workforce is axially clamped.

Briefly described, the present invention depends on the motor shaft of the cut-off tool which has been externally threaded with a left-hand thread. The shaft also has a hole drilled in its end and is internally threaded with a right hand thread. The tool head has a hex adapter which is internally threaded at its proximal end to accommodate the left-hand thread of the motor shaft. The hex adapter has a d-shaped hole bored into its distal end to accommodate the wheel retainer which has a corresponding external shape. The wheel retainer is hollow as to accommodate a right-hand threaded screw to be inserted through it and threaded into the corresponding internal threads of the motor shaft.

The two opposing threads in the tool head will keep it from coming loose and allowing the grinding wheel to become detached. When the tool is in clockwise operation or "forward" operation the right-hand screw will tighten causing the wheel retainer to lock the grinding wheel into place. When the tool is in counter-clockwise or "reverse" operation, the left-hand threaded hex adapter will tighten against the wheel retainer locking the wheel into place. Additionally, a non-rotational feature such as a d-slot and corresponding shape of the wheel retainer will prevent the rotation of the wheel retainer with respect to the hex adapter which might otherwise cause the screw to loosen. This novel feature is key to keeping the wheel retainer from accidentally disengaging.

The present invention is described more fully in the following drawings and description:

DETAILED DESCRIPTION OF PREFERRED EMBODIMENT(S)

Figure 1:
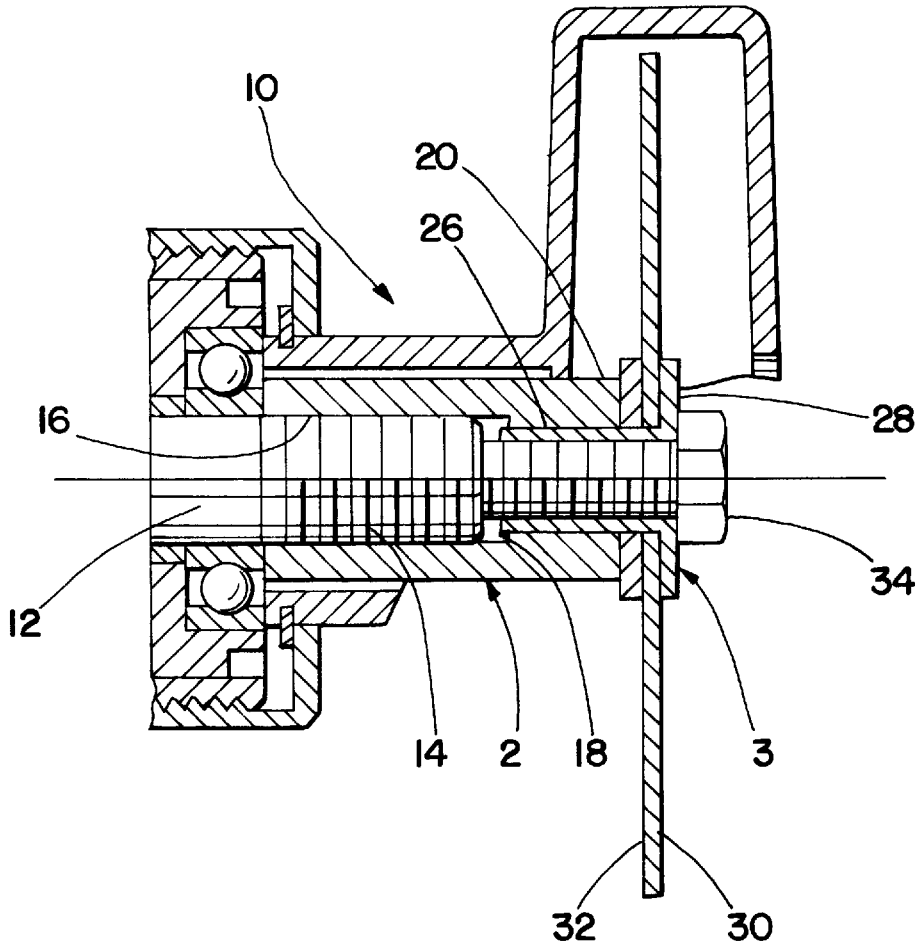
FIG. 1 is a partial sectional schematic view of a preferred embodiment of the present invention.
Figure 2:
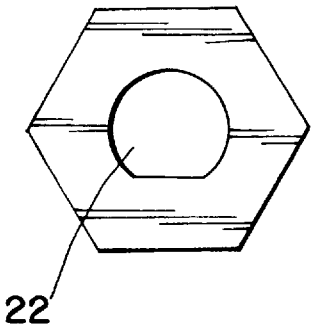
FIG. 2 is a distal end elevation of the hex adapter of a preferred embodiment of the present invention.
Figure 3:
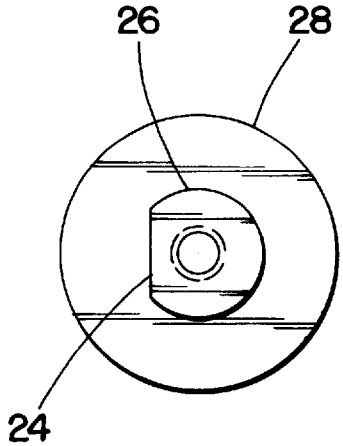
FIG. 3 is a proximal end elevation of the wheel retainer of a preferred embodiment of the present invention.
Figure 4:
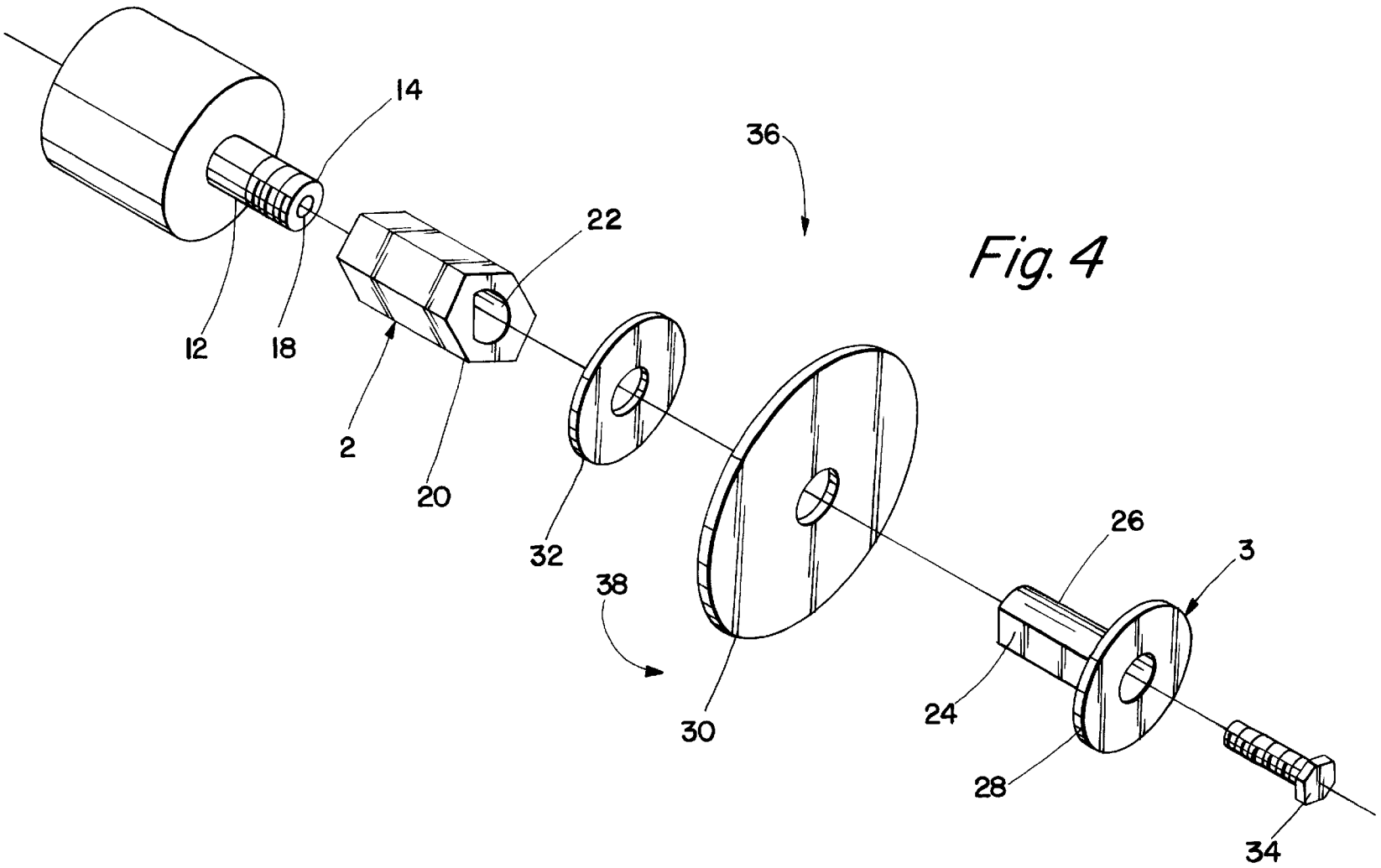
FIG. 4 is an exploded perspective view of a preferred embodiment of the present invention.

Referring now to FIG. 1, there is shown a forward portion of a reversible cut-off tool 10. A motor shaft or rotor 12 is threaded with a left-hand thread at its distal end 14. A hex adapter 2 has a section with a hexagonal external shape as shown in FIGS. 2 and 4 to facilitate its attachment to rotor 12 using a corresponding hex wrench. As shown in FIG. 1, hex adapter 2 is hollow and is threaded on the interior wall of its proximal end 16 with a left-hand thread to accommodate the corresponding thread of the distal end 14 of rotor 12. The distal end 14 of rotor 12 is also hollow and it is threaded with a right-hand thread on its interior wall 18. The distal end 20 of hex adapter 2 is bored out in a non-circular shape such as a "D" shape referred to as a D-slot 22, as shown in FIGS. 2 and 4. A wheel retainer 3 has a shaft 26 and flange 28 configuration with a milled flat 24 on shaft 26 causing the exterior shape of wheel retainer 3 to correspond to the interior shape of the D-slot 22 as shown in FIGS. 3 and 4. The wheel retainer is inserted through a cutting wheel 30 and a retainer washer 32, which have center openings slightly larger than the external diameter of shaft 26 of wheel retainer 3, and is then inserted into D-slot 22 in the distal end 20 of hex adapter 2. Wheel retainer 3 is secured in place by a right-hand threaded screw 34 which is inserted through wheel retainer 3, cutting wheel 30, retainer washer 32 and hex adapter 2 and threaded and tightened into the corresponding internal thread of interior wall 18 of distal end 14 of rotor 12. The complete assembly of the aforesaid parts is easily seen by referring to FIG. 4.

Again referring to FIG. 4, when reversible cut-off tool 10 is operated in the clockwise or "forward" direction 36, right-hand threaded screw 34, because of a resulting rotational force, will tend to tighten into interior wall 22 of distal end 20 of hex adapter 2. This action will cause wheel retainer to clamp tightly against cutting wheel 30. Simultaneously, wheel retainer 3, by pressing against cutting wheel 30 and retainer washer 32, clamps hex adapter 2 against rotor 12 keeping hex adapter 2 from loosening itself from rotor 12 as such a clockwise rotation 36 would otherwise tend to cause.

When reversible cut-off tool 10 is operated in the counter-clockwise or "reverse" direction 38, left-hand thread of interior wall 16 of hex adapter 2 will tend to tighten onto corresponding exterior left-hand thread of distal end 14. The method of fitting wheel retainer 3 and hex adapter 2 together using D-slot 22 and corresponding flat 24 of shaft 26 of wheel retainer 3 does not allow for any rotation relative to the two parts. Therefore, no rotational force is translated to the right-hand threaded screw 34. This is especially important during counter-clockwise operation 38 of reversible cut-off tool 10, otherwise screw 34 would tend to loosen due to the resulting counter-clockwise force.

As a result, all of the components in this preferred embodiment of the present invention remain securely fastened to the reversible cut-off tool during both forward and reverse operation.

What is claimed is:

1. A reversible clamping hub for a reversible rotary power tool comprising:

a) a motor shaft having an opening in one end, the motor shaft having an external thread on the outside of the motor shaft, and an internal thread in the opening, the internal thread being threaded in a direction opposite to the external thread, b) a hollow sleeve having an internal thread at a first end to engage the external thread of the motor shaft, c) a rotary tool wheel with a center hole, d) a wheel retainer with a flange on a distal end thereof, and e) a screw having an external thread to engage the internal thread of the motor shaft, wherein the internal thread of the sleeve engages the external thread of the motor shaft, the wheel retainer is inserted through the tool wheel, and the screw is inserted through the wheel retainer, the tool wheel, and the sleeve and the external thread of the screw engages the internal thread in the opening of the motor shaft.

2. The reversible clamping hub of claim 1 wherein an exterior wall of the wheel retainer has a non-round cross-sectional shape and wherein a distal portion of the interior wall of the sleeve has a corresponding non-round cross-sectional shape.

3. The reversible clamping hub of claim 2 wherein an exterior wall of the sleeve has a cross-sectional shape which is hexagonal.

4. The reversible clamping hub of claim 2 in which the tool wheel is an abrasive grinding wheel.

5. The reversible clamping hub of claim 2 in which the non-round shaped opening of the sleeve is a "D" shape.

6. The reversible clamping hub of claim 2 in which the wheel retainer flange is shaped to engage the non-round shaped opening of the sleeve.

7. The reversible clamping hub of claim 1 wherein an exterior wall of the sleeve has a cross-sectional shape which is hexagonal.

8. The reversible clamping hub of claim 1 in which the tool wheel is an abrasive grinding wheel.

9. A reversible clamping hub for a reversible rotary power tool comprising:

a) a motor shaft having an opening in one end, the motor shaft having an external thread on the outside of the motor shaft, and an internal thread in the opening, the internal thread being threaded in a direction opposite to the external thread, b) a sleeve positioned on the motor shaft, the sleeve having an opening with an internal thread which engages the external thread of the motor shaft, c) a rotary tool wheel positioned on the motor shaft, d) a wheel retainer inserted in the tool wheel, and e) a screw inserted through the wheel retainer, the tool wheel, and the sleeve, the screw having an external thread which engages the internal thread in the opening of the motor shaft.

10. The reversible clamping hub of claim 9 wherein an exterior wall of the wheel retainer has a non-round cross-sectional shape and wherein at least a portion of an interior wall of the sleeve has a corresponding non-round cross-sectional shape.

11. The reversible clamping hub of claim 10 wherein an exterior wall of the sleeve has a cross-sectional shape which is hexagonal.

12. The reversible clamping hub of claim 10 wherein the non-round shaped opening of the sleeve is a "D" shape.

13. The reversible clamping hub of claim 10 wherein the wheel retainer has a flange, the flange being shaped to engage the non-round shaped opening of the sleeve.

14. The reversible clamping hub of claim 9 wherein an exterior wall of the sleeve has a cross-sectional shape which is hexagonal.

15. The reversible clamping hub of claim 9 wherein the tool wheel is an abrasive grinding wheel.

* * * * *